US005544830A

United States Patent [19]

Kudrus

[11] Patent Number: 5,544,830

[45] Date of Patent: Aug. 13, 1996

[54] CHANGING DEVICE FOR A MACHINE FOR SIMULTANEOUS SPOOLING OF SEVERAL PARALLEL THREADS

[75] Inventor: Heiner Kudrus, Barmstedt, Germany

[73] Assignee: Neumag-Neumünstersche Maschinen-Und Anlagenbau GmbH

[21] Appl. No.: 191,000

[22] Filed: Feb. 3, 1994

[30] Foreign Application Priority Data

Feb. 11, 1993 [DE] Germany ..... 43 04 055.1

[51] Int. Cl.[6] ..... B65H 54/28; B65M 57/28

[52] U.S. Cl. ..... 242/43 A; 242/158 R

[58] Field of Search ..... 242/43 A, 158 R, 242/18 G

[56] References Cited

U.S. PATENT DOCUMENTS

| | | | |
|---|---|---|---|
| 3,362,652 | 1/1968 | Butterworth | 242/43 |
| 3,650,486 | 3/1972 | Hasegawa et al. | 242/43 |
| 3,823,886 | 7/1974 | Siegenthaler | 242/43.1 |
| 4,165,047 | 8/1979 | Mackie | 242/43 A |
| 4,505,437 | 3/1985 | Schippers et al. | 242/43 R |
| 4,674,694 | 6/1987 | Hasegawa et al. | 242/43 R |
| 4,867,386 | 9/1989 | Schroff et al. | 242/43 |
| 4,991,783 | 12/1991 | Sugioka | 242/43 A |

FOREIGN PATENT DOCUMENTS

| | | | |
|---|---|---|---|
| 0114642 | 1/1984 | European Pat. Off. . | |
| 0194648 | 9/1986 | European Pat. Off. . | |
| 322752 | 7/1989 | European Pat. Off. | 242/43 A |
| 3307915 | 6/1984 | Germany . | |
| 8335804 | 5/1985 | Germany . | |

*Primary Examiner*—William Stryjewski
*Attorney, Agent, or Firm*—Michael J. Striker

[57] ABSTRACT

In blade changing devices the phase length of the oppositely rotating blades of a changing unit must be exactly determined to guarantee at the ends of the changing region a reliable thread transfer. When the arrangement is composed of several changing units, the first rotors are driven by a common drive belt in form of a flat multi-shaft transmission and the second rotors are driven by another common drive belt. Due to length deviations of the both drive belts phase errors can occur and lead to disturbances of the thread laying. In order to eliminate this, the first rotors of all changing units are driven by a single drive belt. The same drive belt drives also the second rotors through a separate intermediate transmission associated with the individual changing units. The arrangement is especially suitable for spooling machines for synthetic threads running with high speed.

5 Claims, 5 Drawing Sheets

CHANGING DEVICE FOR A MACHINE FOR SIMULTANEOUS SPOOLING OF SEVERAL PARALLEL THREADS

BACKGROUND OF THE INVENTION

The present invention relates to changing devices. More particularly, it relates to a changing device for a machine for simultaneous pulling of several threads which run parallel to one another.

Changing units for spooling of threads beads for example 6,000 m/min are known. In these changing units the threads are guided reciprocatingly by blades which are arranged as propellers on two rotors rotatable opposite to one another with constant rotary speeds. The alternating movement of the threads is actuated therefore not as in the conventional changing units by a single reciprocatingly movable thread guide, but instead by blades movable in opposite directions in two adjacent planes so as to alternatingly engage and guide the threads. The transfer of the thread from one blade of another rotor is performed by eccentric arrangement of the shaft of one rotor relative to the shaft of the other rotor and/or by additional stationary thread guiding elements, such as for example a thread guiding ruler. The changing is performed without reciprocatingly moved machine parts.

One of such changing devices, of which the changing device of the present invention is a further important improvement and modification, is disclosed in the German document DE-OS 33 07 915, FIG. 9. This changing device is used for a machine with simultaneous spooling of several threads which run parallel to one another. In correspondence with the number of the threads the changing device has several blade changing units which are arranged in a row so that the blades of the first rotors of all changing units are located jointly in a single first plane, while the blades of the second rotors of all changing units are located in a single second plane.

The blades of the adjacent changing units rotate in opposite directions both in the first plane and in the second plane. With a respective phase position, the rotary circles can overlap so that the blades do not strike one another or do not hinder the opposite position. The overlapping of the rotary circles is positively provided by the requirement that the intermediate spaces between the changing strokes of the adjacent changing units are to be maintained very small. The spool sleeves on which the threads are wound can be clamped on a single long spool spindle, so that they are located at their end sides close to one another.

In the known arrangement the drive of the first rotors and the drive of the second rotors is formed as flat multi-shaft drive. A drive belt provided with teeth on its both sides engages with a toothed drive pulley and surrounds the toothed pulley of the first rotors of the adjacent changing units. Another drive belt engaging with a toothed drive pulley surrounds the toothed pulley of the second rotors of the adjacent changing units at alternating side.

The length of the drive belts can deviate from their nominal value because of manufacturing tolerances, aging process, pulling tension produced during operation, and temperature fluctuations. In the case of a belt transmission such deviations lead to phase errors of the rotors. The greater is the length between the driving pulley and the driven pulley the greater can be the phase error. The deviations can have different magnitudes in different belts and can be subjected to uncontrollable changes. In the known arrangement, due to different length variations of both drive belts in the rotors, the changing units located the farthest from the driving pulley can obtain phase differences of several degrees. Such differences lead to disturbances in laying of threads.

The European patent document EP-B1-0 194 648 deals especially with the problem of providing a play-free exact phase length of the blade, for avoiding the undesired disturbances of the thread laying. This reference discloses a changing unit in which the first rotor is driven from an inner toothing of the second rotor through a transmission shaft. This shaft as well as the shaft of the first rotor is supported in an eccentric bushing which is displaceable relative to the housing. By turning the eccentric bushings relative to one another, the transmission unit during mounting of the transmission can be adjusted so that no tooth gaps are provided. Then the blades are mounted on the base body so that they occupy exactly fixed positions. This construction is extremely complicated and expensive.

SUMMARY OF THE INVENTION

Accordingly, it is an object of the present invention to provide a changing device which avoids the disadvantages of the prior art.

In keeping with these objects and with others which will become apparent hereinafter, one feature of the present invention resides, briefly stated, in a changing device in which the rotor pairs of the individual changing units are associated with one roller which has a first toothed rim and a second toothed rim, the drive rims surround the toothed pulley of the first rotor and the first toothed rim of the associated roller at alternating sides, and a toothed belt surrounds, in form of an open belt drive, the toothed pulley of the second rotor and the second toothed rim of the associated roller.

When the changing device is designed in accordance with the present invention, the phase differences are reduced to an acceptable level with simple means.

In accordance with the present invention, in each changing unit one of the both rotors is driven directly by the drive belt. The other rotor is driven indirectly from the drive belt by means of the associated roller arranged near the rotor pair. Thereby the influence of occurring length deviations of the drive belt upon the relative phase position of the both rotors is reduced to an acceptable level. The active run lengths between the both rotors and the associated roller are so small that they can cause only insignificant phase differences.

When the changing device in accordance with the present invention is compared with the changing device of the prior art, it can be seen that it can reduce the error by a factor in the order of 10. The transmission elements required for obtaining this improvement are simple toothed pulleys and toothed belts which are manufactured in mass production by respective manufacturers and therefore are relatively inexpensive.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
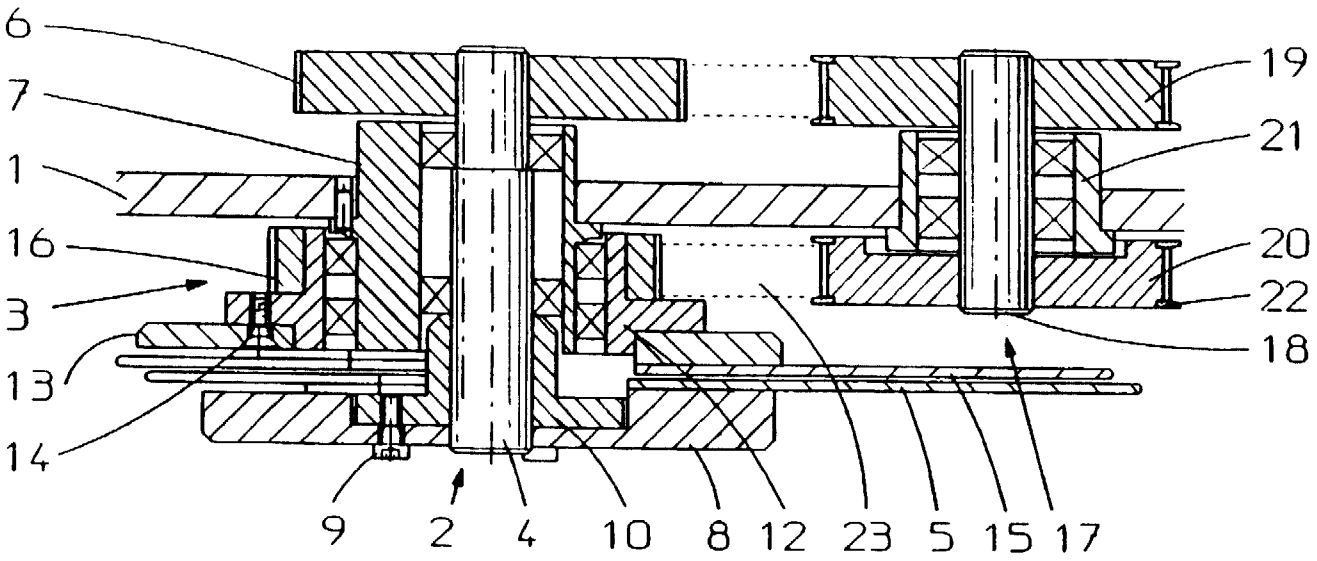
FIG. 1 is a view showing a section of a changing unit of a changing device in accordance with the present invention.

A changing unit in accordance with the present invention shown in FIG. 1 is mounted on a base plate 1. It includes a rotor pair composed of a first rotor 2 and a second rotor 3.

The first rotor 2 has a shaft 4, a propeller-like arrangement of blades 5, and a toothed pulley 6. The shaft 4 is supported in an eccentric opening of a bushing 7 which extends through a circular opening of the base plate 1 and is screwed on the base plate.

Figure 2:
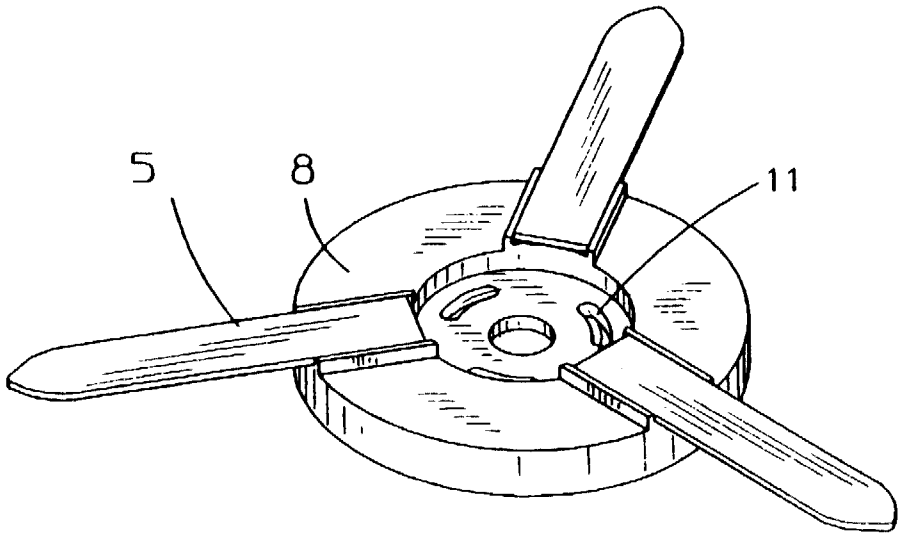
FIG. 2 is a perspective view of a propeller-shaped blade arrangement of the inventive changing device.

As can be seen from FIG. 2, three blades 5 which are adjustable in radial direction are mounted on a disc 8. They are connected by screws 9 with a flange of a holding ring 10 supported on one end of the shaft 4. The openings 11 of the disc 8 through which the screws 9 extend, have the shape of short arcs and provide an angular adjustment of the disc 8 relative to the shaft 4. The toothed pulley 6 is mounted on the other end of the shaft 4.

A ring-shaped base body 12 of the second rotor 3 is supported on the cylindrical surface of the bushing 7 between the disc 8 and the base plate 1. Blades 15 are mounted on a flat ring 13 which is connected by screws 14 with the base body 12, similarly to the blades 5 on the disc 8. A toothed pulley 16 is arranged on the base body 12.

A roller 17 is arranged close to the roller pair 2, 3. It includes a shaft 18, a first toothed rim 19 and a second toothed rim 22. The shaft 18 is rotatably supported in a bearing bushing 21 which is screwed with the base plate 1. The toothed rims 19 and 20 are mounted on both ends of the shaft 18, so that their main planes coincide with the main planes of the toothed pulleys 6 and 16 respectively. They are provided with flanged discs.

An 0-shaped toothed belt 23 is wrapped around the toothed pulley 16 and the toothed rim 20 in form of an open belt transmission. The bearing bushing 21 is arranged eccentrically. The opening in which the bearing of the shaft 18 is located, is arranged eccentrically relative to the cylindrical outer surface. By a small rotation of the bearing bushing 21, the tensioning of the toothed belt 23 can be adjusted.

Figure 3:
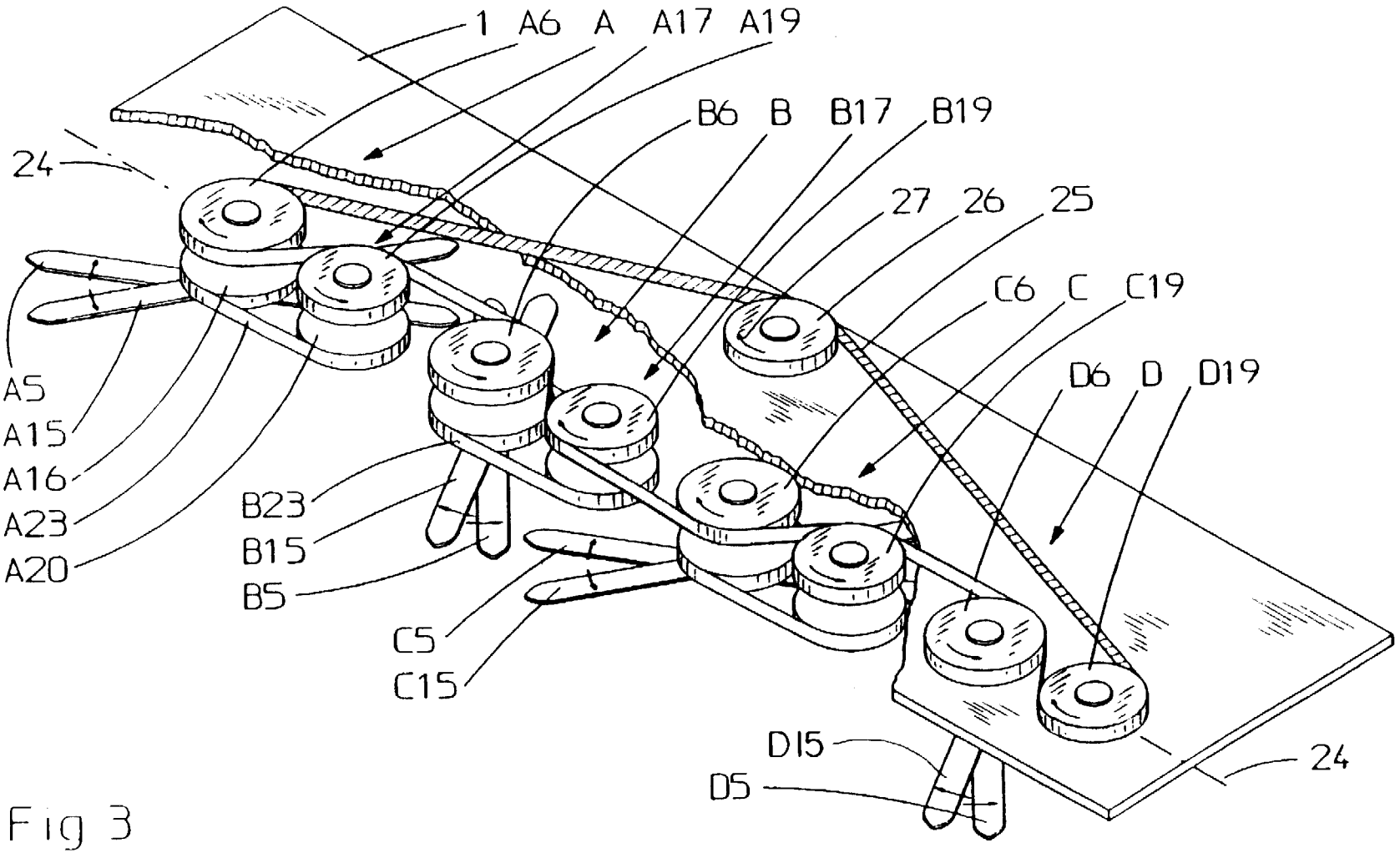
FIG. 3 is a perspective view of the changing device in accordance with the present invention.

FIG. 3 shows a changing device which is composed of four changing units A, B, C, D. For each changing unit, the respective parts are identified with the same reference numerals with addition of a letter corresponding to the changing unit.

The four changing units A, B, C, D are arranged in a series on the common base plate 1, so that the points in which the axes of all rotors A2, B2, C2, D2 extend through the plane of the base plate 1 are located on a straight line 24. The rotors 2, 3 have in this embodiment each two blades.

The rotary circles of the blades A5, B5, C5, D5 are located in a common plane, while the rotary circles of the blades A15, B15, C15, D15 are located also in a plane extending parallel to the first mentioned plane and adjacent to the latter. The distances from the rotor pairs A2, A3 of the changing unit A to the rotor pairs B2, B3 of the changing unit B are dimensioned so that the rotary circles of the blades A5, A15 intersect the rotary circles of the blades B5, B15. The blades B5 are phase-offset relative to the blades A5 by 90° C. and the blades B15 is phase-offset relative to the blades A15 by the same angle. The same is true for all remaining changing units. The rollers A17, B17, C17, D17 are arranged alternatingly with the respective roller pairs. Their rotary axes extend through the plane of the base plate 1 on the line 24 as well.

The common drive is formed as a flat multi-shaft transmission. The drive belt 25 which is toothed at both sides is in engagement with a toothed drive pulley 26 and engages the toothed pulleys A6, B6, C6, D6 and the toothed rims A19, B19, C19, D19. It is wrapped around the toothed pulley A6 and the toothed rim A19 in a substantially S-shape, so that the toothing of the one side of the drive belt 25 engages with the toothed pulley A6 while the toothing of the other side engages with the toothed rim A19. The toothed pulley B6 of the neighboring changing unit is engaged by the same side of the drive belt 25 as the toothed rim A19.

The toothed rim B19 engages with the other side of the drive belt 25. In order to illustrate the alternating side wrapping, one side of the drive belt 25 is provided in FIGS. 3–6 with points while the other side is provided with hatching.

The drive pulley 26 is mounted on the shaft of a not shown motor and rotates during the operation in direction of the arrow 27. The toothed pulley A6 and the blade A5 together with it rotates in the same rotary direction. Due to the alternating-side belt wrapping the toothed rim A19 and with it also the toothed rim A20 are driven in an opposite direction. Due to the open belt transmission A20, A23, A16 the blade A15 is rotated in the same direction as the roller A17 and opposite to the blade A5. The transmission ratios are selected so that the blades A5, A15 rotate with the same rotary speed. Also, the toothed pulley B6 and with it the blade B5 rotate in opposite direction relative to the toothed pulley A6. The roller B17 operates so that the blade B15 is rotated in the opposite rotary direction. The same is true with respect to the further changing units C, D.

Figure 4:
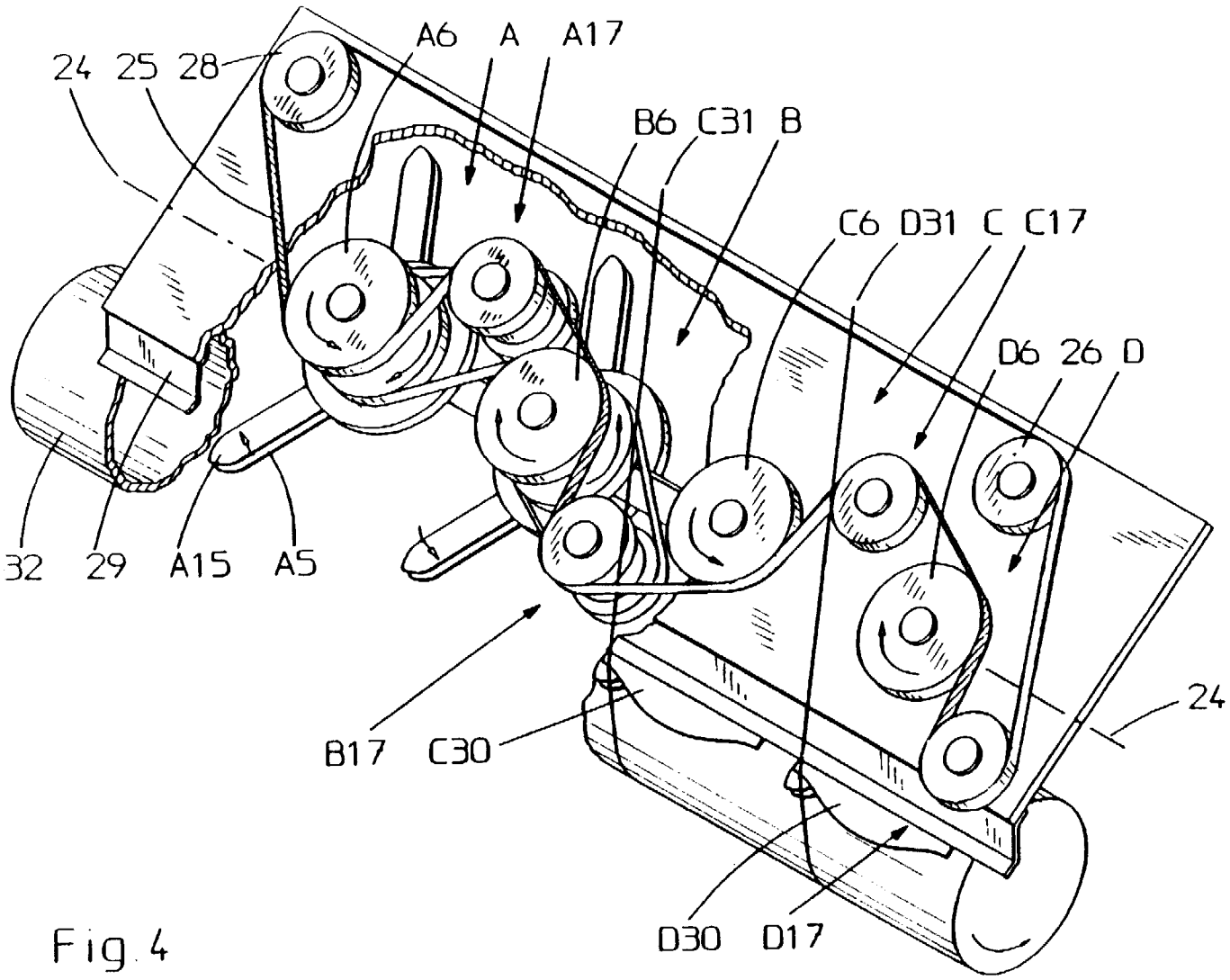
FIG. 4 is a perspective view of a changing device in accordance with another advantageous embodiment of the invention.

In a different embodiment shown in FIG. 4, the rotor pairs of the changing units A, B, C, D are arranged in series, in other words, along a straight line 24. The rollers A17, B17, C17, D17 are arranged alternatingly at one or other side of the line 24. Due to the different configuration, the drive belt is guided over an additional deviating pulley 28. The operation of this device is similar to the operation of the device of FIG. 3.

In the embodiment of FIG. 4, with the given changing stroke, greater toothed pulleys 6, 16 and toothed rims 19, 20 can be provided. It is especially advantageous for smaller changing strokes.

The mounting of the device is illustrated in FIG. 4 by showing additional parts required for this. For the individual changing units A, B, C, D, a curved thread-guiding ruler C30, D30 is respectively mounted on the base plate 1 by a profile strip 29, so that the supplied threads C31, D31 are applied on the thread guide rulers during the operation. The guiding ruler provides a reliable changing in a known manner. A guiding roller 32 is located under the thread guiding rulers C30, D30, and the thread wraps around it along an arc. The not shown spool is arranged inclinedly under the guiding roller 32. The spooling machine and the arrangement of the changing device on the spooling machine corresponds to the prior art. Therefore specific description of this issue is superfluous.

The both above described embodiments can be modified so that the common drive belt 25 engages with the toothed pulleys A16, B16, C16, D16 and the toothed rims A20, B20, C20, D20, and the toothed pulleys A6, B6, C6, D6 are driven indirectly through the intermediate transmission A17, B17, C17, D17; A23, B23, C23, D23.

This arrangement must be considered as less advantageous in the practice. However, it also belongs to the basic inventive idea, in which the terms "first rotor" and "second rotor" can be used interchangeably.

Figure 5:
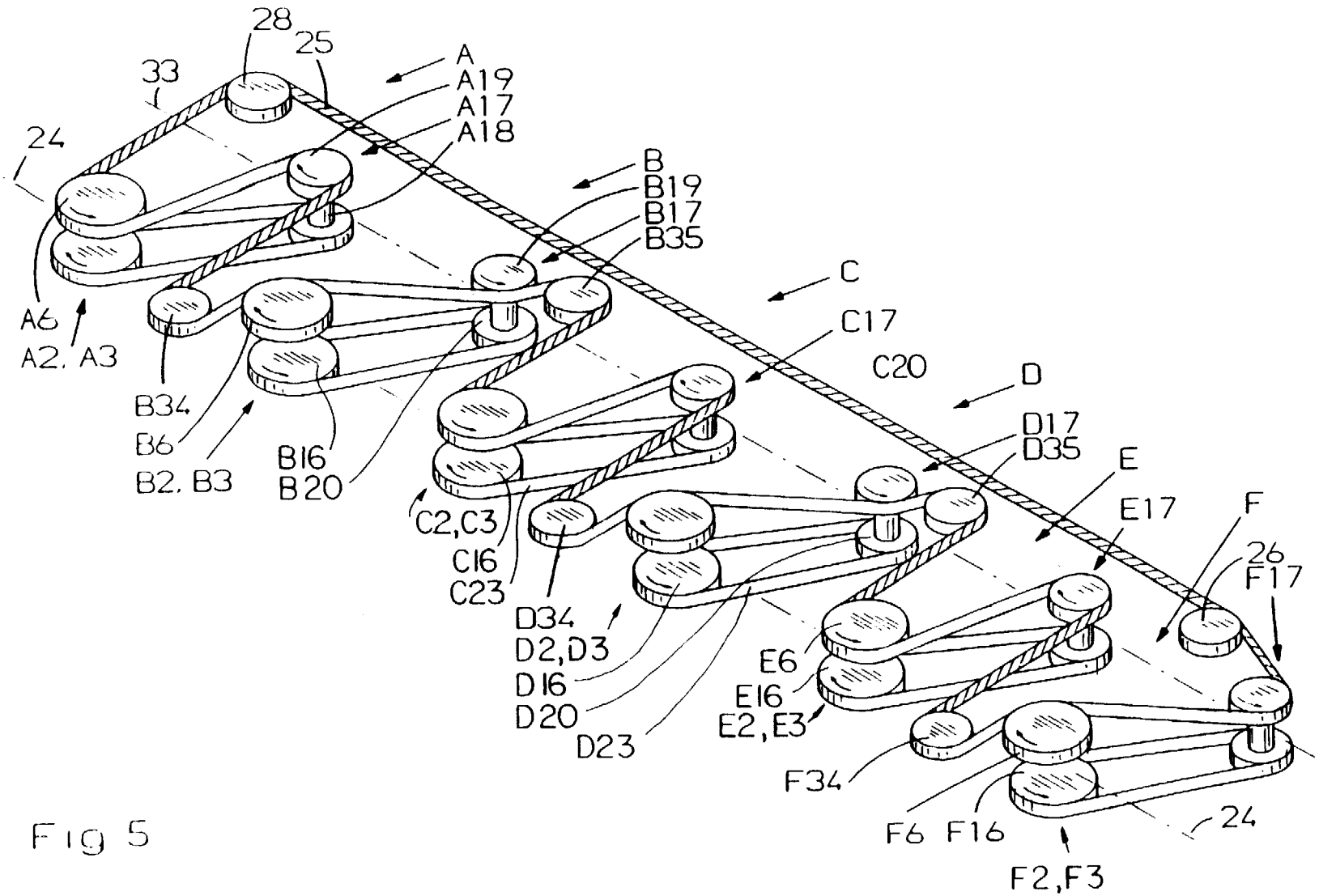
FIG. 5 is a substantially simplified perspective view of a further changing device in accordance with the present invention.
Figure 6:
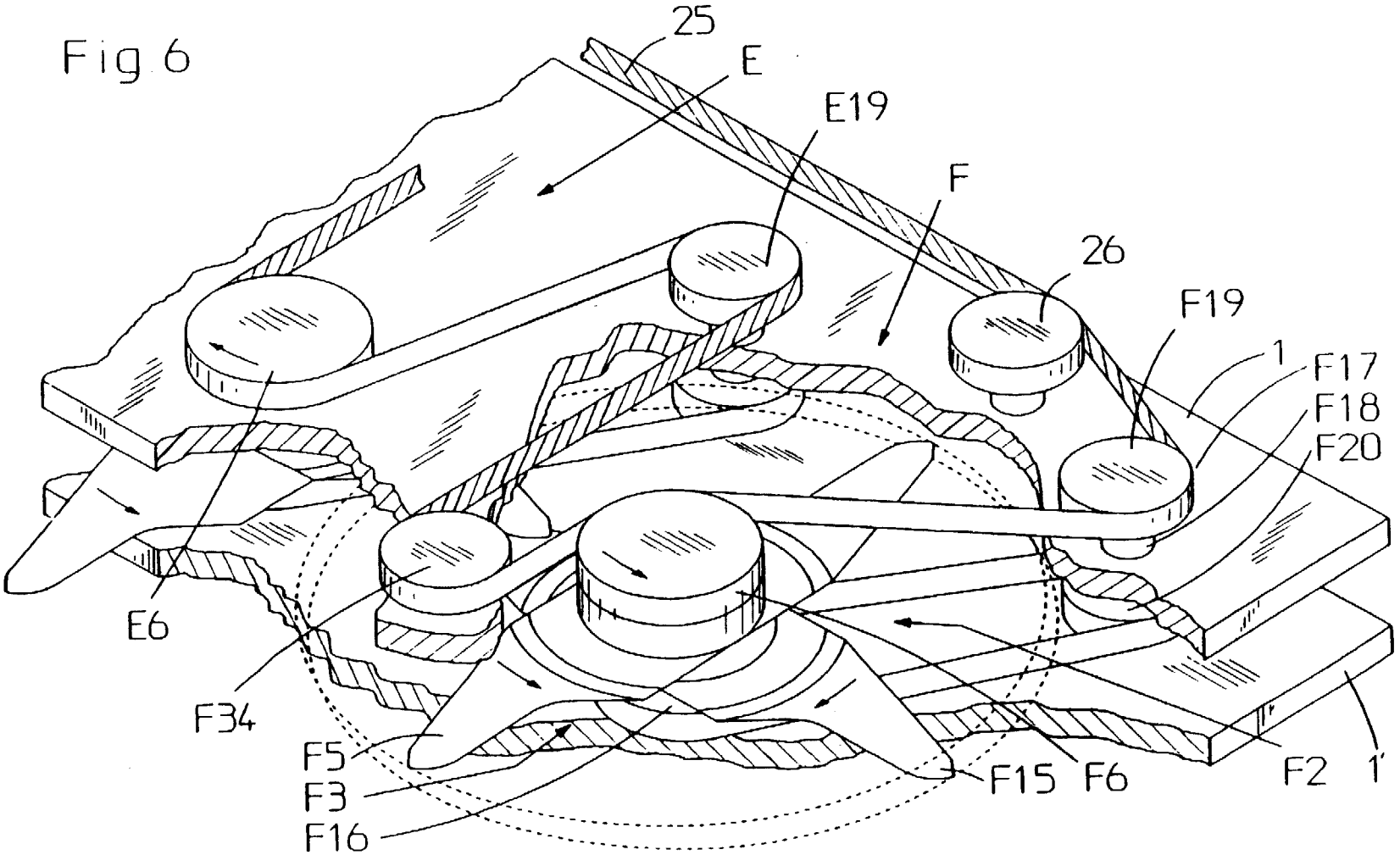
FIG. 6 is a fragment of FIG. 5 on an enlarged scale, with additional details.

FIGS. 5 and 6 show an embodiment of the inventive device which has six changing units A–F. As shown in FIG. 6 for example for the changing unit F, the rotor F2 with the blades F5 and the toothed pulley F6 is mounted on the base plate 1. The bearings of the rotor F3 which has the blade F15 and the toothed pulley F16 are mounted on an additional plate 1' which is arranged parallel to the base plate 1. Both rotors can be supported coaxially. Their axes can be also laterally offset relative to one another as shown for the embodiment of FIG. 1. The planes in which the blades F5 and F15 rotate are located close to one another between the base plate 1 and the plate 1'. In contrast to FIG. 1, the rotary plane of the blade 15 of the rotor F2 is located closer to the base plate 1 than the rotary plane of the vane F15 of the rotor F3. The toothed pulley F6 is arranged at the side of the base plate 1 which is opposite to the plate 1', or in other words at the upper side in FIG. 6. The same is true for the toothed rim F19 of the roller F17, whose shaft F18 extends through the base plate 1. The toothed rim F2 is located similarly to the toothed pulley F6 of the rotor F3, in the intermediate space between the base plate 1 and the base plate 1'.

As shown in FIG. 5 which illustrates the course of the drive belt 25 and instead of the complete rotors shows only the toothed pulleys A6, B6, C6, D6, E6, F6; A16, B16, C16, D16, El6, F16 without the associated propeller-like blade arrangement, the rotor pairs are arranged along a straight line 24. The roller A17 whose shaft A18 extends through the base plate 1, is located substantially in the tip of a unilateral triangle whose basis is located between the rotor pairs A2, A3 and B2, B3 and whose side length is selected so that the rotation of the vanes is not hindered by the shaft 18. The rollers B17, C17, D17, El7, F17 of the remaining changing units are arranged correspondingly. In other words, they are arranged in a row along a line 33 which is parallel to the line 24 and with gaps relative to the neighboring rotor pairs.

The drive belt 24 is wrapped around the toothed pulley A6 as a hair pin, and also around the toothed rim A19 but with opposite curvature. Between the toothed rim A19 and the toothed pulley B6 the drive belt 25 is guided over an additional guiding pulley B34 provided with a toothing. It is rotatably supported at a short distance from the toothed pulley B6. A similar guiding pulley B35 is supported at a short distance from the toothed rim B19. The drive belt 25 is guided over it between the toothed rim B19 and the toothed pulley C6. The guiding pulley B34, the toothed pulley B6, the toothed rim B19, and the guiding pulley B34 are arranged in series approximately along a straight line, so that they are wrapped by the drive belt 25 at alternating sides.

The changing units C and E correspond to the changing unit A, the changing unit D corresponds to changing unit B. The changing unit F arranged at the end of the row differs from the changing units B and D only in that the toothed rim F19 does not have an associated guiding pulley. The returning run of the drive belt 25 runs over a drive pulley 26 and a deviating pulley 28.

It will be understood that each of the elements described above, or two or more together, may also find a useful application in other types of constructions differing from the types described above.

While the invention has been illustrated and described as embodied in a changing device, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A changing device for a machine for simultaneous spooling of several parallel threads, comprising a plurality of changing units arranged in series, each of said changing units including a first rotor and a second rotor, each of said rotors being provided with a propeller-like set of blades and a toothed pulley rotatable jointly with said set, said blades of said first rotors of all said changing units being located in a first plane while said blades of said second rotors of all of said changing units being located in a second plane, each of said changing units having a transmission which couples said first rotor with said second rotor so that said first rotor and said second rotor rotate in opposite directions, said transmission including a drive belt provided with teeth at its both sides and wrapped around said toothed pulleys of said first rotors of said changing units so as to engage said toothed pulleys of adjacent ones of said changing units at alternating sides of side pulleys, a roller associated with said first and second rotors of each of said changing units and having a first toothed rim and a second toothed rim, said drive belt being wrapped around said toothed pulley of said first rotor and said first toothed rim of an associated one of said rollers at alternating sides of side pulleys, and a toothed belt wrapped in form of an open belt transmission around said toothed pulley of said second rotor and said second toothed rim of an associated one of said rollers.

2. A changing device as defined in claim 1, wherein said first and second rotors and said roller of each of said changing units are arranged alternatingly along a straight line.

3. A changing device as defined in claim 1, wherein said first rotor and said second rotor of each of said changing units are arranged along a straight line and said associated rollers are arranged alternatingly at both sides of said straight line.

4. A changing device as defined in claim 1, wherein said first rotor and said second rotor of each of said changing units is arranged along a straight line and said associated rollers are arranged along another straight line which extends parallel to said first straight line; and further comprising additional guiding pulleys arranged so that said drive belt is guided between said toothed rim of one of said changing units and said toothed pulley of a neighboring one of said changing units over said additional guiding pulleys.

5. A changing device as defined in claim 1, and further comprising a drive pulley, said drive belt engaging with said drive pulley.

* * * * *